US007165911B2

(12) United States Patent
Fier

(10) Patent No.: US 7,165,911 B2
(45) Date of Patent: Jan. 23, 2007

(54) MANHOLE COVER RISER ASSEMBLY

(75) Inventor: Raymond L. Fier, Carrollton, OH (US)

(73) Assignee: American Highway Products, Ltd., Bolivar, OH (US)

( * ) Notice: Subject to any disclaimer, the term of this patent is extended or adjusted under 35 U.S.C. 154(b) by 130 days.

(21) Appl. No.: 10/962,325

(22) Filed: Oct. 8, 2004

(65) Prior Publication Data

US 2006/0078381 A1 Apr. 13, 2006

(51) Int. Cl.
*E02D 29/14* (2006.01)

(52) U.S. Cl. ..... 404/26; 404/25

(58) Field of Classification Search ..... 404/25, 404/26

See application file for complete search history.

(56) References Cited

U.S. PATENT DOCUMENTS

| | | | | |
|---|---|---|---|---|
| 1,517,871 | A | 12/1924 | Thompson | |
| 1,710,571 | A | 4/1929 | Fomi | |
| 2,190,532 | A | 2/1940 | Lukomski | |
| 2,346,361 | A | 4/1944 | Cupido | |
| 2,431,082 | A | 11/1947 | Sayles | |
| 2,593,918 | A | 4/1952 | Redman | |
| 3,240,133 | A | 3/1966 | Ross | |
| 3,385,011 | A | 5/1968 | Sorrell | |
| 3,408,778 | A | 11/1968 | Mason | |
| 3,891,337 | A | 6/1975 | McCoy | |
| 3,968,600 | A | 7/1976 | Bowman | |
| 4,097,171 | A | 6/1978 | Fier | |
| 4,188,151 | A | 2/1980 | Hall | |
| 4,225,266 | A | 9/1980 | Fier | |
| 4,236,358 | A | 12/1980 | Bowman | |
| 4,466,219 | A * | 8/1984 | Campolito | 52/20 |
| 4,690,584 | A | 9/1987 | LeBaron | |
| 4,969,770 | A * | 11/1990 | Bowman | 404/26 |
| 4,976,568 | A * | 12/1990 | Hess | 404/26 |
| 4,995,757 | A | 2/1991 | Prescott | |
| 5,082,392 | A * | 1/1992 | Marchese et al. | 404/25 |
| 5,326,188 | A * | 7/1994 | Bowman | 404/25 |
| 5,451,119 | A | 9/1995 | Hondulas | |
| 5,697,729 | A * | 12/1997 | Bowman | 404/25 |
| 5,899,024 | A | 5/1999 | Stannard | |
| 5,996,612 | A | 12/1999 | Crawford | |
| 6,109,822 | A * | 8/2000 | Campbell et al. | 404/25 |
| 6,161,984 | A * | 12/2000 | Sinclair | 404/25 |
| 6,550,294 | B2 * | 4/2003 | Garguilo | 70/168 |
| 6,688,072 | B1 | 2/2004 | Gavin | |
| 6,688,807 | B2 * | 2/2004 | Navarrete | 404/25 |

OTHER PUBLICATIONS

Andrews Metal Products, Inc. Sales Flyer, 1 page, date unknown.

* cited by examiner

*Primary Examiner*—Gary Hartmann
(74) *Attorney, Agent, or Firm*—Sand & Sebolt

(57) ABSTRACT

A riser assembly for supporting a manhole cover is placed within a manhole frame for raising the height of the manhole cover to pavement level. The riser assembly includes a circular frame formed of a metal bar and has a locking ring attached thereto which extends vertically downwardly from the frame. A plurality of outwardly projecting tabs are formed in the locking ring and are adapted to engage the manhole frame to prevent upward movement of the riser. An expansion device expands the frame and locking ring outwardly whereby the locking ring abuttingly engages a vertical surface of the manhole frame to assist in locking the riser assembly to the manhole frame.

9 Claims, 7 Drawing Sheets

MANHOLE COVER RISER ASSEMBLY

BACKGROUND OF THE INVENTION

1. Technical Field

The invention relates to manhole cover supports, and in particular to a separate riser assembly placed within an existing manhole frame to raise the height of the manhole cover to compensate for added roadway pavement. More particularly, the invention relates to a riser assembly which is locked in position within the manhole frame preventing horizontal and vertical movement therein.

2. Background Information

Most underground facilities such as sanitary and storm sewers, utility conduits, and the like have manhole openings to provide access thereto. These manholes usually are located in the street or roadway and consists of an inverted, generally bell-shaped metal frame mounted on top of a brick or concrete base structure. This metal frame has an internal, horizontal ledge for supporting the manhole cover so that the top of the cover is level with the top of the frame and surrounding roadway pavement.

Problems arise in the resurfacing of the roadways in that a layer of pavement is placed on top of the existing pavement resulting in the manhole cover being below the top surface of the new pavement, causing a depression in the roadway. It is quite difficult and expensive to raise the existing manhole frame sufficiently to compensate for the added pavement. Thus, various devices and methods have been constructed and used which enable an existing manhole cover to be raised to the level of the new pavement surface without raising the existing manhole frame. Some examples of these devices and methods are shown in U.S. Pat. Nos. 1,517,871, 3,218,943, 3,773,428, 3,891,337, 4,097,171, 4,225,266, 4,302,126, 4,690,584, and 4,995,757.

Many of these prior art devices use a metal frame formed with a gap wherein the metal frame sits upon a generally horizontal surface of the manhole frame and includes a device for expanding the frame outwardly into abutting engagement with a upwardly outwardly extending conical surface formed on the manhole frame, which prior to the installation of the new pavement formed the seat for receiving the manhole cover thereon. However, in certain manhole frames, this conical surface forms an excessively large obtuse angle with the adjacent horizontal ledge resulting in the riser frame moving upwardly from its seated position within the frame when forced outwardly by the expansion device and subjected to various forces, making it difficult to retain the riser frame assembly within the manhole opening. The horizontally outwardly extending force component exerted by the expansion device is not sufficient to retain the riser frame within the manhole opening due to the excessive large taper or angle of the conical surface of the manhole frame. Furthermore, it has been found that sliding and shifting of the riser assembly can occur within the manhole opening providing an unwanted movement of the riser assembly, which could occur over time caused by thermal expansion of the ground or supporting structure or movement by snow plows or repetitive motion of vehicle tires moving over the manhole cover.

U.S. Pat. No. 4,690,584 shows one manner of solving this problem by the use of concrete reinforcing steel bars welded to the riser frame. The bars are bent outwardly beneath a retaining lip of the manhole frame to secure the riser assembly in position. Although this construction may provide a suitable solution, it requires a number of additional manufacturing steps such as welding the bars to the riser frame and then requiring the welded bars to be bent inwardly after placement into the manhole frame by repeatedly striking the bars with a hammer to bend the bars in position. However, the bent bars may not provide a secure lock with the adjacent manhole frame still resulting in some movement of the riser frame within the manhole frame causing rattling and other unwanted results. Also, if such bendable bars are used with riser assemblies which have an outward expansion device, it does not provide any assistance in overcoming the unwanted movement of the riser assembly due to the large angle of the manhole frame conical surface.

Thus, the need exists for a manhole assembly, and in particular, for a manhole riser assembly which enables the riser assembly to be securely retained both vertically and horizontally within the manhole frame in a simple and less expensive manner than heretofore achieved by prior riser assemblies.

BRIEF SUMMARY OF THE INVENTION

The present invention provides a manhole riser assembly which can be formed relatively inexpensive, yet includes devices for horizontally expanding the frame outwardly into a secure clamping position with the existing manhole frame, and which includes a device for preventing unwanted upward vertical movement of the riser assembly within the manhole frame.

Another feature of the invention is to provide a riser assembly which is clamped against a generally vertical surface of the manhole frame instead of the heretofore conical surface which forms the manhole cover seat, to prevent premature upward movement of the riser assembly irrespective of the angle of the conical surface of the manhole cover seat.

A still further feature of the manhole riser assembly of the present invention is to provide a downwardly extending locking ring which is expanded outwardly into clamping engagement with a horizontal surface of the manhole frame, and which is formed with a plurality of locking projections which can be lanced directly from the locking ring as tabs or formed as integral outwardly extending dimples, forming the projections without requiring the attachment of additional locking components as in prior art devices.

Another feature of the riser assembly of the present invention is to enable the manhole riser frame to be formed from a rectangular-shaped bar having an upwardly extending skirt welded thereto to compensate for the height of the resurface pavement, or in which the riser frame can be formed as a single one-piece member, with the locking ring being secured to either of the riser frame configurations and extend downwardly therefrom, with the locking projections being formed in the locking ring.

The foregoing advantages construction and operation of the present invention will become more readily apparent from the following description and accompanying drawings.

BRIEF DESCRIPTION OF THE SEVERAL VIEWS OF THE DRAWINGS

Preferred embodiments of the invention, illustrative of the best modes in which Applicant has contemplated applying the principles, are set forth in the following description and shown in the accompanying drawings and are particularly and distinctly pointed out and set forth in the appended claims.

Similar numbers refer to similar parts throughout the drawings.

DETAILED DESCRIPTION OF THE INVENTION

Figure 1:
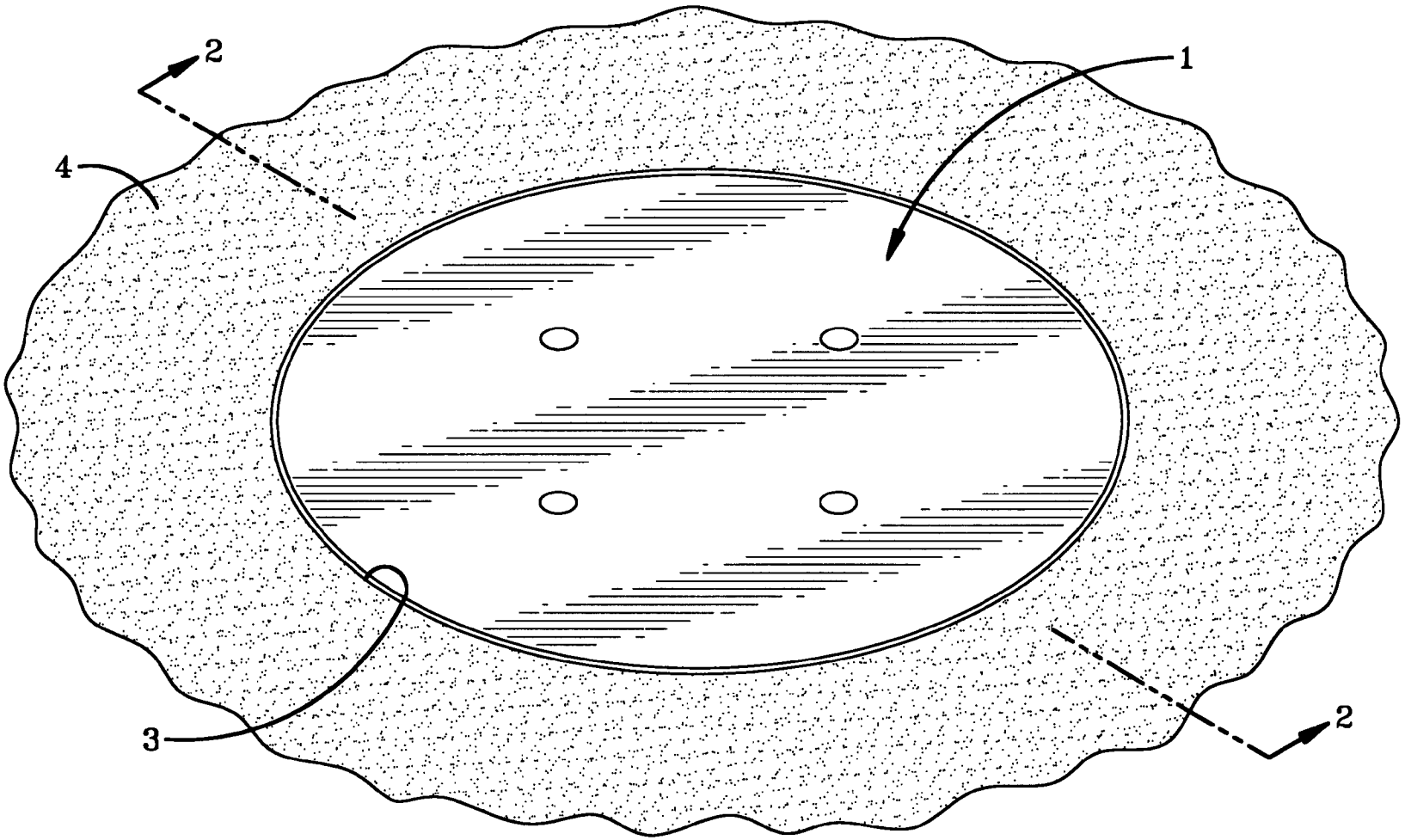
FIG. 1 is a top perspective of a typical manhole installation in a paved surface.

The improved riser assembly of the present invention used for adjusting the elevation of a manhole cover is shown in the drawings and particularly in FIG. 1, which shows a manhole cover 1 mounted within a manhole opening 3 after having been raised to the level of a new pavement 4.

Figure 2:
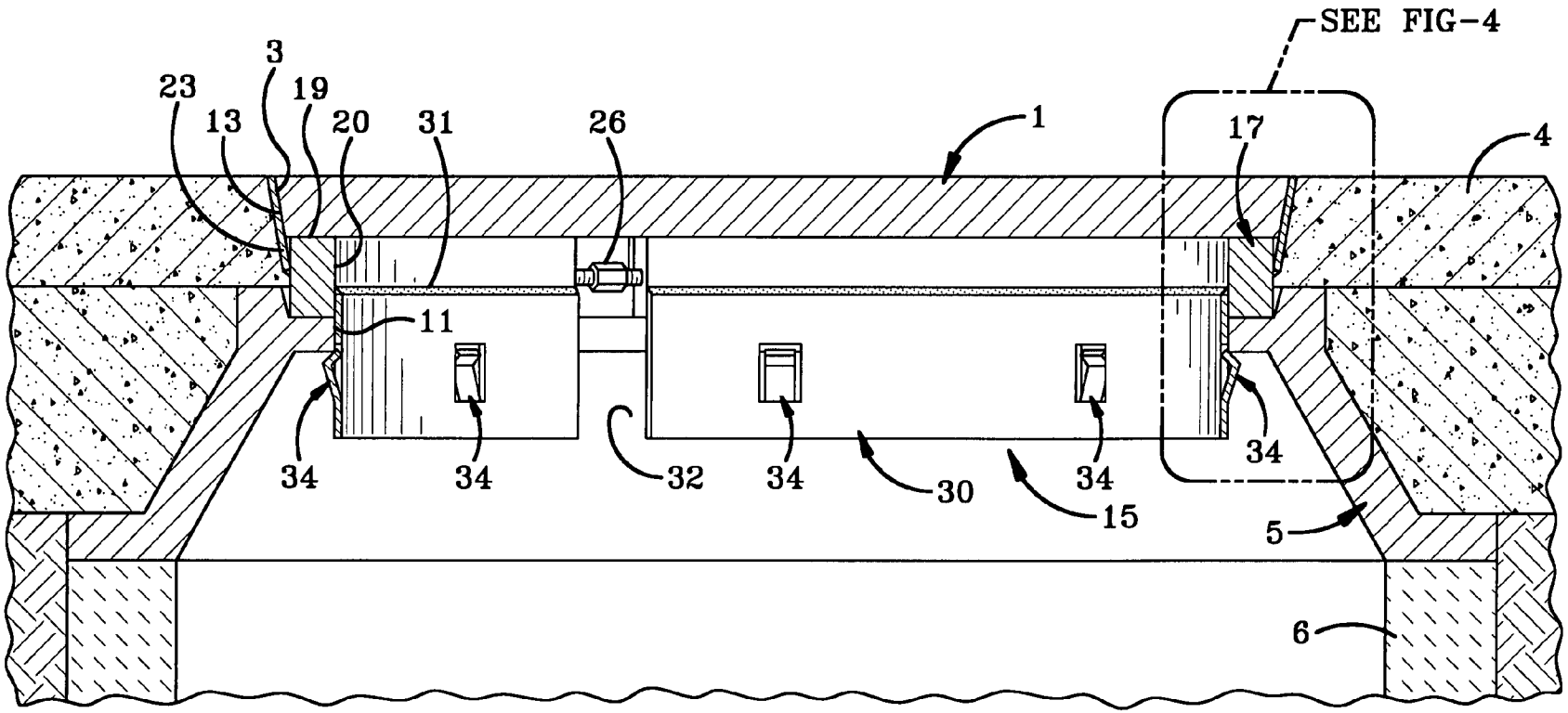
FIG. 2 is a sectional view taken on line 2—2, FIG. 1.

Referring particularly to FIG. 2, a usual manhole frame is indicated generally at 5, and consists of a bell-shaped frame mounted on the top of a brick or masonry catch basin 6. Frame 5 includes a generally horizontal support surface 8 (FIG. 4) and a conical surface or wall 9, which prior to the addition of a new layer of pavement 4, provided the seat for receiving and supporting manhole cover 1. Frame 5 further includes a generally vertically extending end surface 11 which forms the actual size of the manhole opening. Manhole frames 5 have various obtuse angles A (FIG. 4) between horizontal cover supporting surface 8 and conical surface 9 in order to match the taper of the sidewall or edge 13 of cover 1. This angle will vary and is usually greater than 90° to facilitate the casting of frame 5 as well as providing a seat for receiving cover 1. However, as discussed above, problems occur if the taper of conical wall 9 is too great. It has been found that angles greater than 8° from the vertical or greater than 98° with respect to horizontal surface 8 can cause retention problems for a riser assembly expanded therein.

Figure 3:
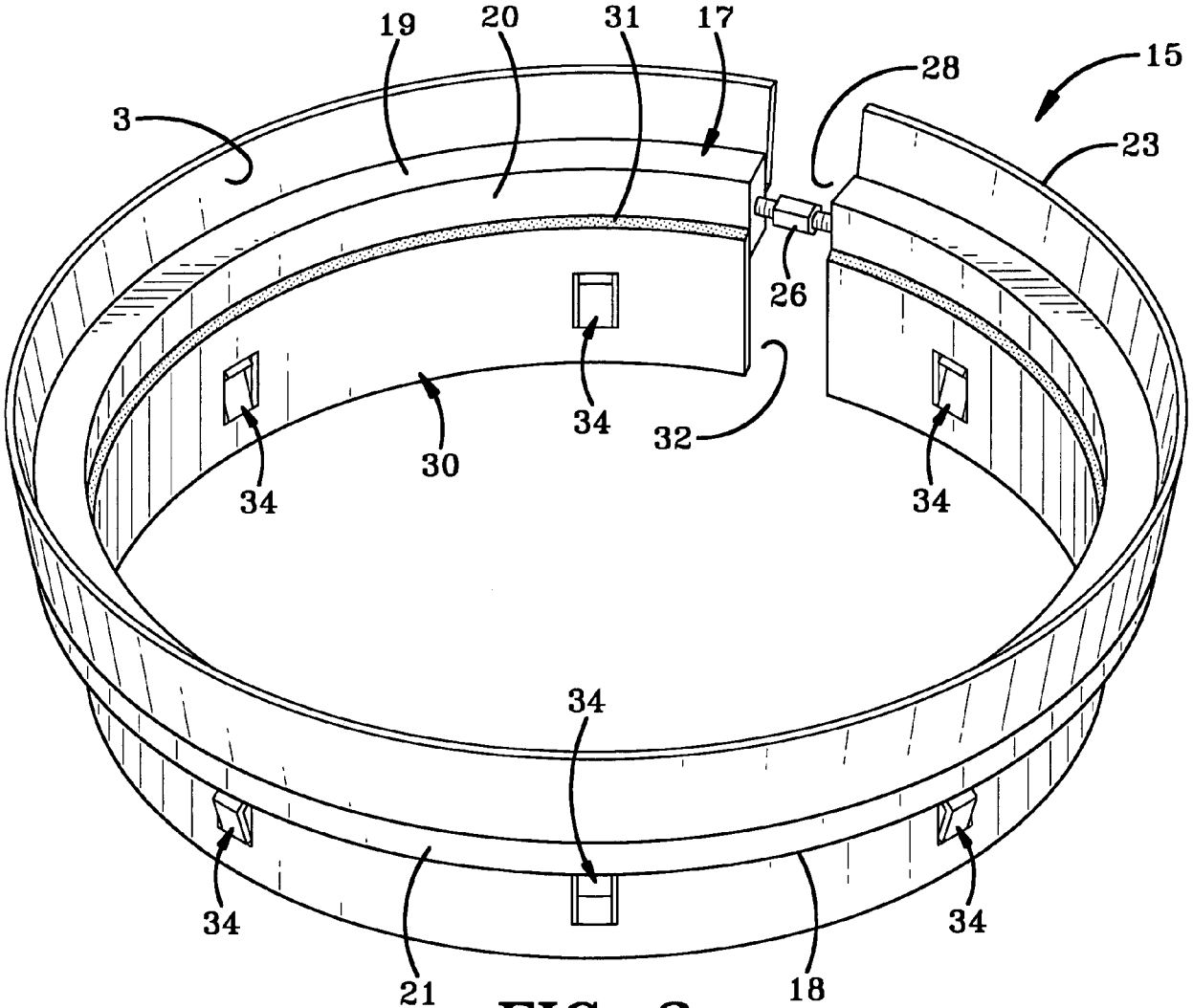
FIG. 3 is a perspective view of one embodiment of the improved manhole riser assembly.
Figure 4:
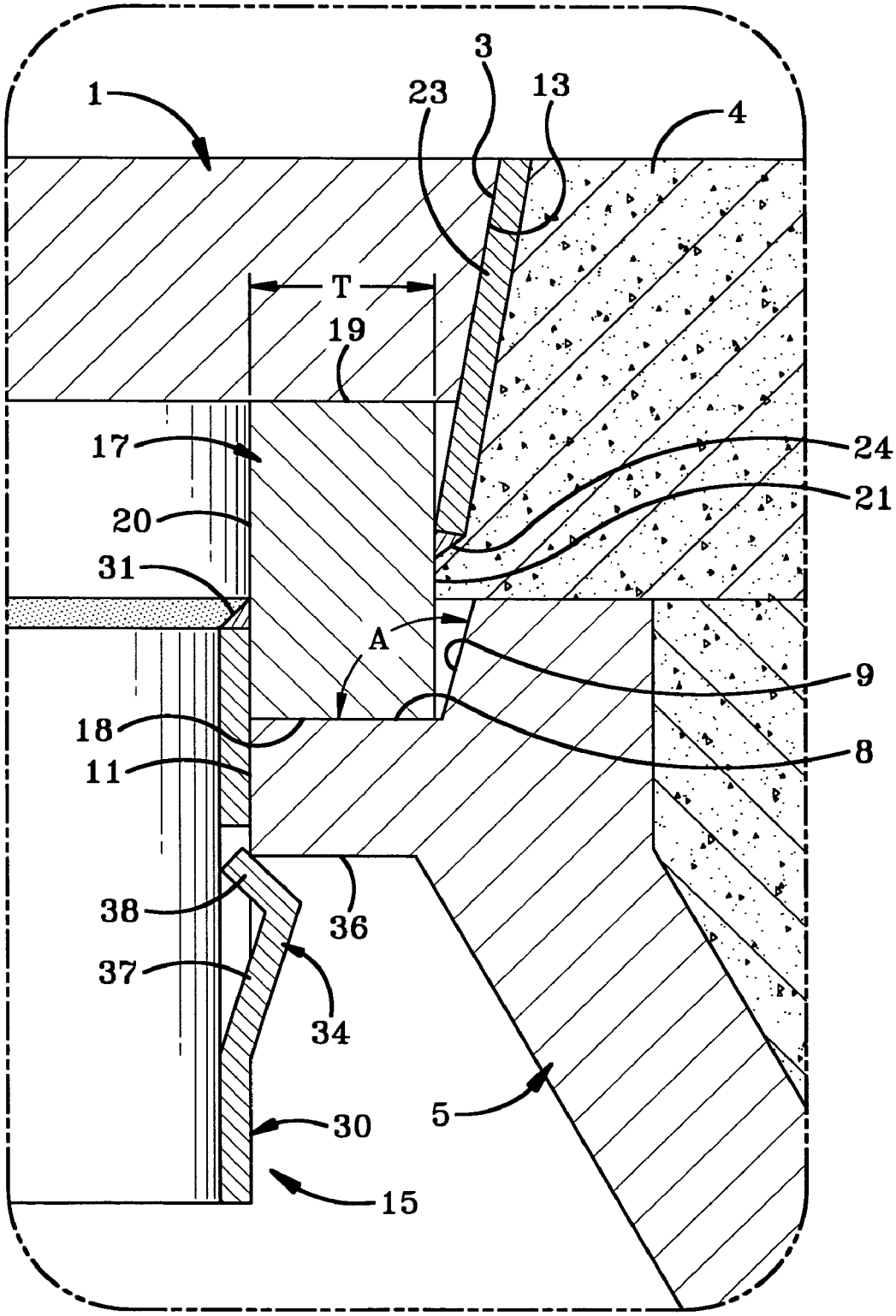
FIG. 4 is a greatly enlarged sectional view of the portion within the dot dash lines of FIG. 2.

The improved manhole cover riser assembly is indicated generally at 15, and includes a main annular riser frame 17, preferably formed of a rectangular-shaped metal bar, as shown in FIGS. 3 and 4, and includes a lower generally horizontal surface 18 and a top surface 19 which is adapted to receive and support manhole cover 1 thereon. Riser frame 17 will also include spaced generally parallel sidewalls 20 and 21. Depending upon the depth of new pavement 4 to be added to a roadway, a generally conical-shaped riser flange 23 is secured to riser frame 17 by welds 24 or other attachment means, and extends upwardly and outwardly therefrom.

Preferably, an expansion mechanism 26 is mounted in a gap 28 formed in riser frame 17 for expanding riser frame 17 outwardly into clamping engagement with the manhole frame. Expansion device 26 can be a turnbuckle as shown in FIG. 3, or other types of expansion mechanisms such as shown in U.S. Pat. Nos. 4,225,226, 3,891,337, and 4,097,171. It is this outward expansion which heretofore forced riser frame 17 against conical surface 9, which if angle A (FIG. 4) was too great, could prevent a secure clamping engagement to be achieved therebetween.

In accordance with the invention, a locking ring indicated generally at 30, is secured to riser frame 17 such as by an annular weld 31. Locking ring 30 is preferably formed with a gap 32 (FIG. 3) which aligns with gap 28 of riser frame 17. Locking ring 30 extends generally vertical downwardly from riser frame 17 and will be expanded radially outwardly with riser frame 17 by expansion device 26, into abutting engagement with the generally vertical surface 11 of manhole frame 5 as shown in FIG. 4. Surface 11 may have a slight taper of several degrees but considerably less than that of conical surface 9, and thus is referred to as being generally vertical. This provides the desired locking engagement between riser assembly 15 and manhole frame 5 instead of relying upon the heretofore locking expansion engagement of riser frame 17 with conical surface 9. Thus, the radial outward locking engagement of riser assembly 15 within the manhole cover opening is unaffected by the angle of conical wall 9 of the manhole frame and provides a pair of generally vertical surfaces which are clamped into an abutting relationship by the radial outward expansion of the riser assembly.

In further accordance with the invention, a plurality of locking projections indicated at 34, are formed integrally in locking ring 30 and extend outwardly therefrom and engage a bottom surface 36 of the inwardly extending horizontal ledge of the manhole frame. One type of locking projection 34 is shown in FIGS. 3 and 4, and is in the shape of an angled tab which has been lanced from locking ring 30. Tab 34 has a first outwardly extending leg 37 and a reversely bent inwardly extending leg 38. As can be seen in FIG. 4, projections 34 retard the upward vertical movement of riser frame assembly 15 with respect to manhole frame 5.

Figure 5:
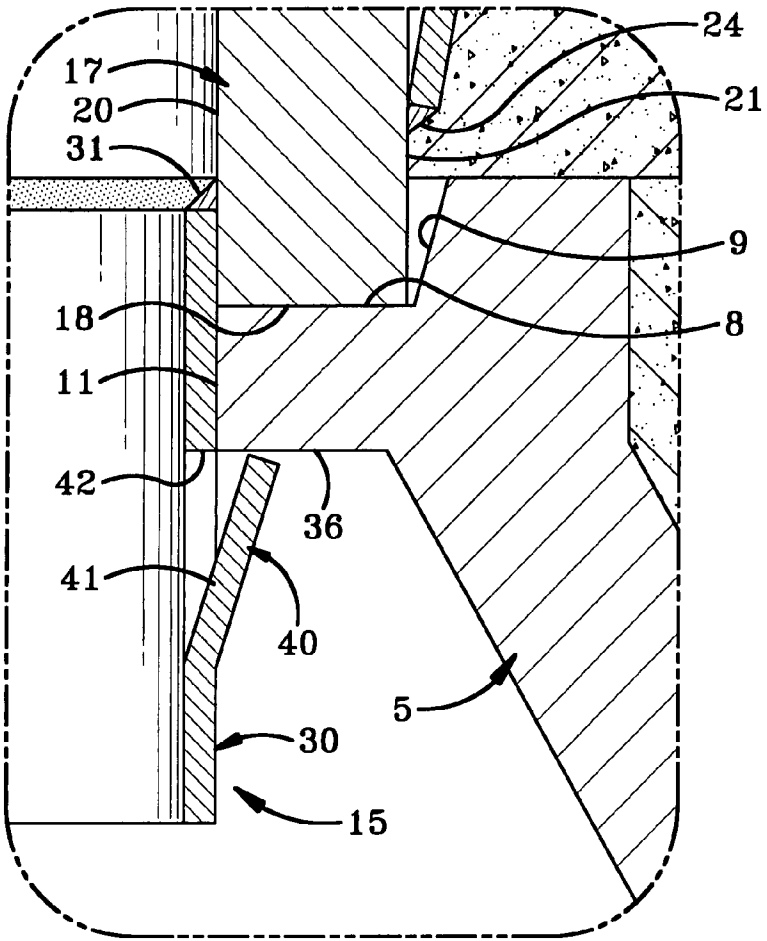
FIG. 5 is a sectional view similar to FIG. 4 showing another type of locking projection than that shown in FIG. 4.

A modified form of the locking projection is indicated generally at 40, and is shown in FIG. 5. Projections 40 are similar to locking projections 34 except they each have only a single outwardly bent upwardly extending leg 41 which is adapted to engage the underside bottom surface 36 of the inwardly extending horizontal ledge of the manhole frame.

Projections 34 and 40 are formed easily in locking ring 30 by a simple lancing procedure which leaves an opening 42 in the area of the locking ring from which it is lanced. Thus a plurality of projections 34 and/or 40 are formed easily in locking ring 30 and are integral therewith, that is, a one-piece member, avoiding the need of any additional components being attached to riser assembly 15 to provide this locking feature.

Figure 6:
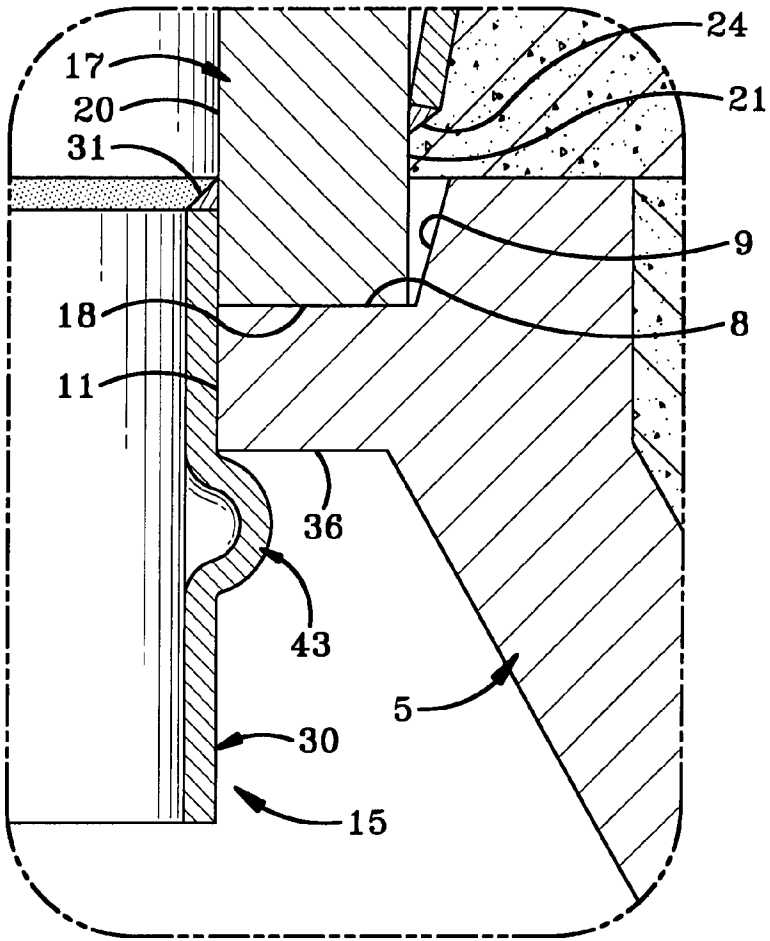
FIG. 6 is an enlarged fragmentary sectional view similar to FIGS. 4 and 5 showing a third type of locking projection.

A third type of locking projection is indicated at 43, and is shown in FIG. 6. Projections 43 are dimples which extend outwardly from locking ring 30, which also prevent or retard the upward movement of riser assembly 15 with respect to manhole frame 5 as do projections 34 and 40. The number of projections 34, 40, and 43 can vary without affecting the concept of the invention, with eight being one amount found satisfactory. These retaining projections also could be a single continuous projection extending partially or completely circumferentially around locking ring 30, instead of the individual spaced projections shown in the drawings and discussed above. Such a continuous projection would still provide the desired retaining feature achieved by projections 34, 40 and 43, which are only three examples of such locking projections.

Thus, the locking projections resist the upward vertical movement of the riser assembly and in combination with the horizontal clamping action achieved by the outward expansion of the riser frame 17, and the subsequent clamping engagement of locking ring 30 with the generally vertical end surface 11 of the manhole frame, provide for the retention of riser assembly 15 within manhole frame 5. For certain applications, such as in smaller manhole frame openings used for water boxes or other types of utility openings and encasements, this retention can be achieved only by the clamping engagement of locking ring 30 with the vertical surface 11 of the manhole frame, or by only the use of locking projections 34, 40, or 43 with the underside surface of the frame opening. However, for larger manhole installations, both types of locking connections, both radial (horizontal) and vertical, are desired and utilized.

As an example, riser frame 17 is a metal bar preferably having a cross-sectional configuration as shown in the drawings with a thickness T (FIG. 4) of between ⅜" and ¾", with locking ring 30 being formed of various metallic materials, such as 12 gauge galvanized steel and/or 14 gauge stainless steel. However, these types of metal and thicknesses will vary depending upon the overall diameter of the riser assembly and its intended use, such as in a manhole large enough for personnel to move through the opening or a small water box opening having a diameter of 8 inches as an example. However, the basic structure will be similar to that shown in the drawing and described above, with just the size and thicknesses and strengths of the material varying.

Figure 7:
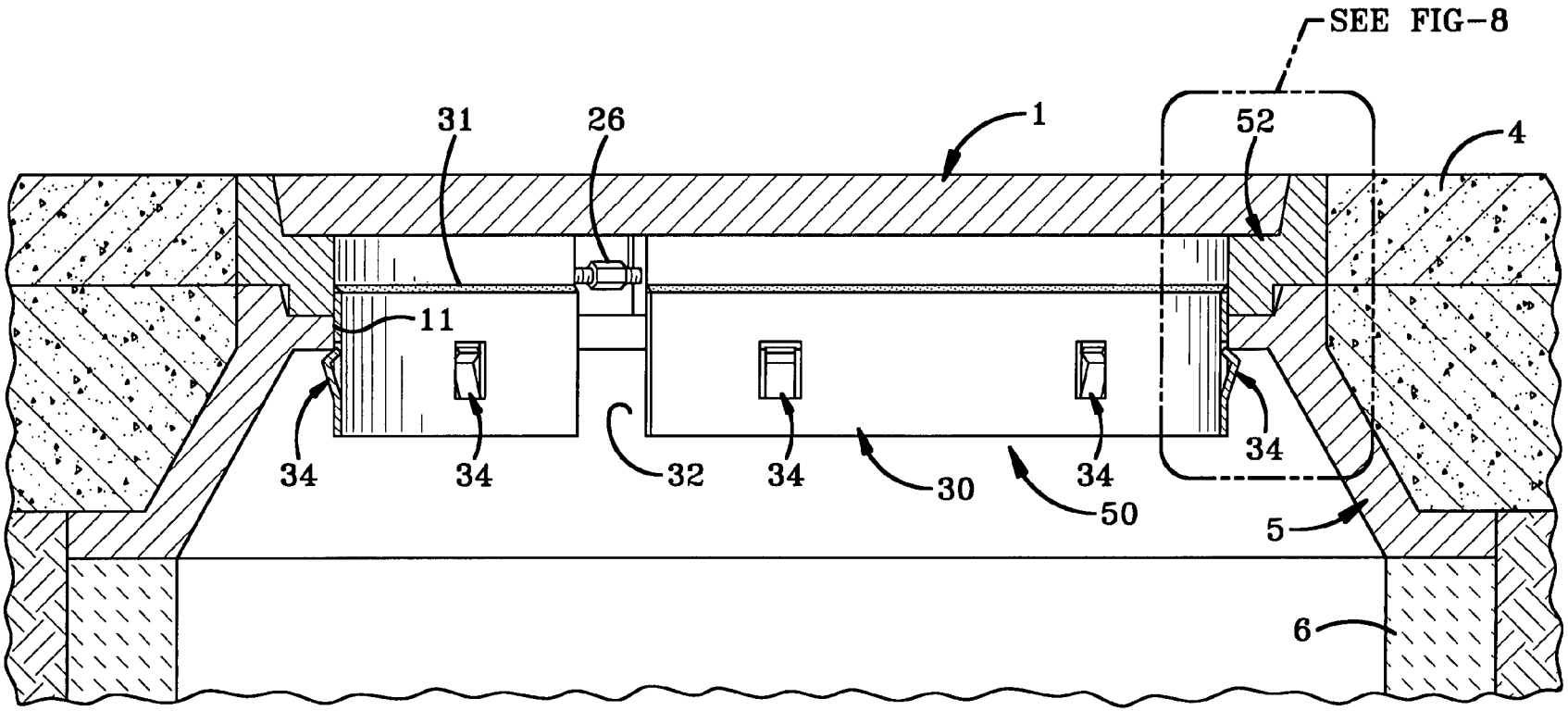
FIG. 7 is a sectional view similar to FIG. 2 showing another form of riser assembly.
Figure 8:
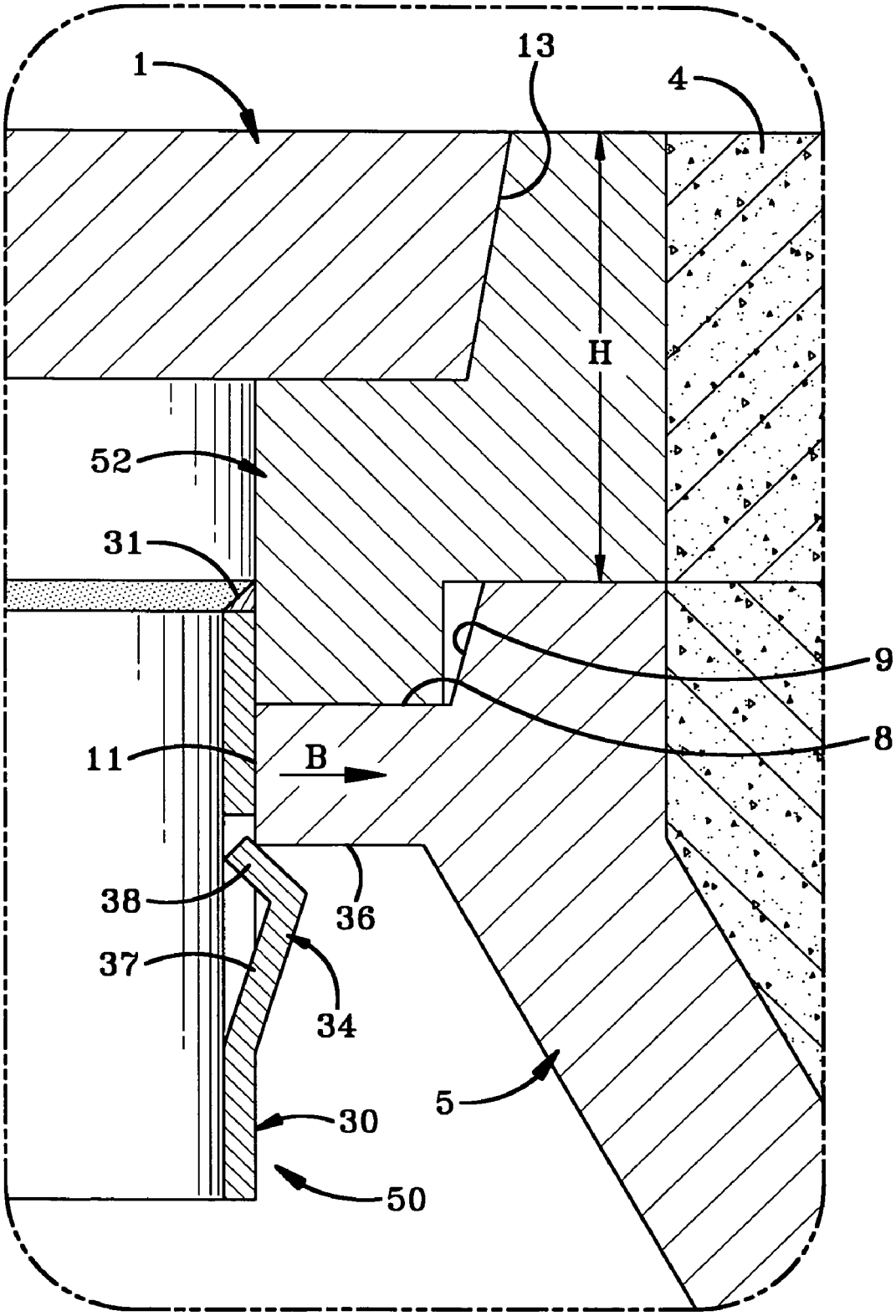
FIG. 8 is an enlarged fragmentary sectional view of the portion within the dot dash lines of FIG. 7.

A modified riser assembly indicated generally at 50, is shown in FIGS. 7 and 8 and includes a one-piece riser frame bar 50 which replaces the separate riser frame 17 and riser flange 23. Locking ring 30 is secured to riser frame 50 and extends downwardly therefrom as discussed above. This one-piece frame 52 will be sized to provide the increased elevation as shown by the distance H (FIG. 8) to match the thickness of the new layer of road material 4. However, the same outward clamping action shown by arrow B, is achieved by use of an expansion device 26, with the vertical retention being provided by locking tabs 34,40,43, etc. Embodiment 50 merely replaces the heretofore two components 17 and 23 with a single piece frame 52. Again, the various thicknesses and heights of the one-piece bar 52 will vary as well as the length and strength of locking ring 30. Again, the type of projections formed in locking ring 30 will be integral therewith, providing locking ring 30 as a one-piece member including the locking tabs, to facilitate the manufacture thereof and to avoid additional separate locking components requiring additional manipulation to secure the riser assembly in position, such as the separate bendable locking bars of U.S. Pat. No. 4,690,584.

It is also understood that for certain applications, such as small utility access openings, the riser assembly could have sufficient flexibility to be partially collapsed and then expanded outwardly by the temporarily compressed hoop after being placed within the manhole frame, eliminating any additional expansion device, such as shown by turnbuckle 26 in the drawings.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A manhole assembly including:

a manhole frame having a downwardly extending inner conical surface and an annular horizontal surface extending inwardly from said conical surface and terminating in a generally annular vertical surface;

a riser assembly including an annular riser frame having a lower surface for supporting the riser frame on the horizontal surface of the manhole frame and an annular metallic locking ring extending downwardly from the riser frame and along the vertical surface of the manhole frame; and said locking ring includes a plurality of locking projections formed integrally therewith to form a one-piece member with said locking projections protecting upwardly outwardly at an acute angle from said ring and having an upper end extending inwardly toward the ring and engageable with the manhole frame when placed thereon to restrict upward movement of the riser frame.

2. The manhole assembly defined in claim 1 wherein a conical flange extends upwardly from the riser frame to form a seat for a manhole cover.

3. The manhole assembly defined in claim 1 wherein the riser frame and locking ring are formed with aligned gaps; and in which an expansion device is located within the gap of the riser frame for expanding the locking ring into abutting engagement with the vertical surface of the manhole frame.

4. The manhole assembly defined in claim 2 wherein the conical surface of the manhole frame forms an angle greater than 98° with the horizontal surface of said manhole frame.

5. The manhole assembly defined in claim 1 wherein the riser frame has a generally rectangular cross-sectional configuration; and the locking ring is an elongated thinner member than said riser frame.

6. The manhole assembly defined in claim 5 wherein the riser frame has a thickness of between ⅜ inch and ¾ inch and the locking ring is formed of 12 to 14 gauge metallic material.

7. The manhole assembly defined in claim 6 wherein the locking ring is 12 gauge galvanized steel.

8. The manhole assembly defined in claim 6 wherein the locking ring is 14 gauge stainless steel.

9. The manhole assembly defined in claim 1 including an expansion device for expanding the locking ring radially outwardly into abutting engagement with the vertical surface of the manhole frame.

* * * * *

UNITED STATES PATENT AND TRADEMARK OFFICE

CERTIFICATE OF CORRECTION

PATENT NO. : 7,165,911 B2
APPLICATION NO. : 10/962325
DATED : January 23, 2007
INVENTOR(S) : Fier It is certified that error appears in the above-identified patent and that said Letters Patent is hereby corrected as shown below:

Column 6, line 21 change “protecting” to --projecting--

Signed and Sealed this

Seventeenth Day of April, 2007

JON W. DUDAS
*Director of the United States Patent and Trademark Office*